US010522023B2

(12) United States Patent
Richey et al.

(10) Patent No.: US 10,522,023 B2
(45) Date of Patent: Dec. 31, 2019

(54) SYSTEMS, METHODS AND APPARATUS FOR PROVIDING ENHANCED SITUATIONAL AWARENESS IN INCIDENTS

(71) Applicant: GenCore Candeo Ltd., Tyler, TX (US)

(72) Inventors: Chad Richey, Tyler, TX (US); James Nipp, Tyler, TX (US)

(73) Assignee: GenCore Candeo, Ltd., Tyler, TX (US)

( * ) Notice: Subject to any disclaimer, the term of this patent is extended or adjusted under 35 U.S.C. 154(b) by 0 days.

(21) Appl. No.: 16/196,867

(22) Filed: Nov. 20, 2018

(65) Prior Publication Data

US 2019/0156646 A1 May 23, 2019

Related U.S. Application Data

(60) Provisional application No. 62/588,732, filed on Nov. 20, 2017.

(51) Int. Cl.

| | |
|---|---|
| ***G08B 25/00*** | (2006.01) |
| ***G08B 21/10*** | (2006.01) |
| ***G08G 1/00*** | (2006.01) |
| ***G08G 1/01*** | (2006.01) |
| ***G08B 27/00*** | (2006.01) |
| *G06Q 50/26* | (2012.01) |

(52) U.S. Cl.

CPC ..... *G08B 21/10* (2013.01); *G08B 25/009* (2013.01); *G08B 27/001* (2013.01); *G08G 1/0141* (2013.01); *G08G 1/202* (2013.01); *G06Q 50/265* (2013.01); *G08B 25/005* (2013.01)

(58) Field of Classification Search

USPC ..... 340/436, 531, 539.18, 539.19, 628

See application file for complete search history.

(56) References Cited

U.S. PATENT DOCUMENTS 9,342,976 B2 * 5/2016 Pfeffer ..... G08B 25/006
9,646,498 B1 5/2017 Brandt et al.

(Continued)

FOREIGN PATENT DOCUMENTS

WO 2016099302 A1 6/2016

OTHER PUBLICATIONS

International Search Report and Written Opinion of International Application No. PCT/US18/62094, dated Jan. 31, 2019; 10 pages.

*Primary Examiner* — Hung T Nguyen

(74) *Attorney, Agent, or Firm* — Perkins Coie LLP; Michael R. Henson

(57) ABSTRACT

Embodiments of systems, apparatus, and/or methods are described for enhanced situational awareness of dispatchers and/or first responders associated with responding to an incident such as an emergency situation by assigning mobile emergency units to a scene of emergency. As such, an emergency response system is disclosed. In some embodiments, the disclosed emergency response system provides an electronic platform for collaboration or partnership involving two or more first responders. In some partnership embodiments, the disclosed emergency response system provides a ranked list of potential candidates than can be assigned to respond to the incident. For example, the potential candidates can be mobile emergency units belonging to a first responder and/or its partner(s). Various beneficial aspects of partnerships and their technical implementations are discussed in detailed herein.

20 Claims, 14 Drawing Sheets

(56) References Cited

U.S. PATENT DOCUMENTS

| | | | | |
|---|---|---|---|---|
| 2007/0103294 | A1* | 5/2007 | Bonecutter | G08B 21/10 340/539.18 |
| 2009/0054029 | A1* | 2/2009 | Hogberg | H04L 41/5006 455/404.2 |
| 2015/0261769 | A1 | 9/2015 | Ono et al. | |
| 2015/0365246 | A1 | 12/2015 | Kane | |
| 2017/0127257 | A1* | 5/2017 | Saxena | H04W 4/023 |
| 2017/0325056 | A1 | 11/2017 | Mehta et al. | |

* cited by examiner

| 601 | 602 Will Call | 604 Date/Time | 606 Trip | 608 Avg. Task Time (hh:mm) | 610 Priority | 612 Chief Complaint | 614 P/U Location | 616 P/U City | 618 D/O Location | 620 D/O City | 622 Notes |
|---|---|---|---|---|---|---|---|---|---|---|---|
| | | 6/19 13:15 | 0187-A | 1:07 | P4 | Routine Tra… | Baylor Scott… | WACO | Quality Car… | WACO | no equip..debilitated..a.. |
| | | 6/19 14:15 | 0175-A | 1:05 | P4 | Routine Tra… | ETMC Tyler | TYLER | Homeplace … | TYLER | no equip..end of life |
| | | 6/19 14:45 | 0007-A | | P5 | Routine Tra… | New Age Heath | TYLER | Trinity Clinic | TYLER | Dr. mark Vig/BLS/MCR#... |
| | ✓ | 6/19 15:00 | 0008-B | 1:40 | P6 | Routine Tra… | Olympic Plaza | TYLER | Heritage N/… | QUITMAN | No equip...Urologist pre… |
| | ✓ | 6/19 16:00 | 0005-B | 0:57 | P4 | Routine Tra... | Renal Care ... | JACKSONVI... | Arbos N/H ... | RUSK | no equip...trmt |

*FIG. 6*

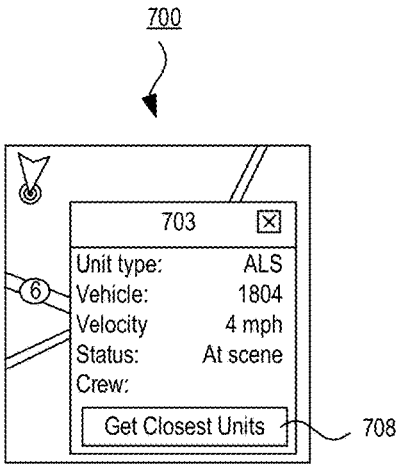
*FIG. 7*
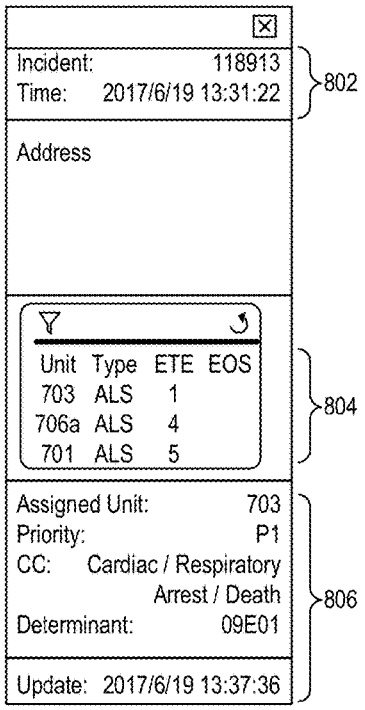
*FIG. 8*
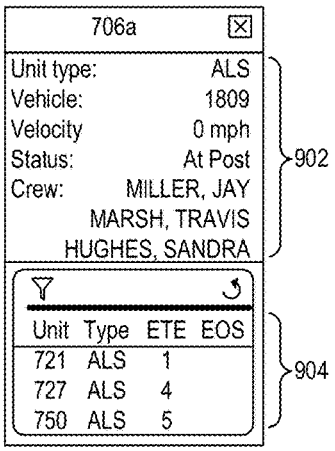
*FIG. 9*
| | | |
|---|---|---|
| | **Unit:** | 820 |
| | **Dispatch Time:** | 00:00:31 |
| **Chute Times** | **Button Push:** | 00:00:05 |
| | **1st AVL Update:** | 00:00:14 |
| | **> 50m Update:** | 00:01:11 (52 meters) |
| | **Enroute Time:** | 00:25:00 |
| | **Total Response Time:** | 00:25:36 |
*FIG. 10*

Unit Utilization Report

Zone/Layer | Smith County

Date Range: November 9-11, 2018

% of Time an Available EMS Unit was inside Polygon: *35%*

% of Time any EMS Unit was inside Polygon: *20%*

% of Time no EMS Units were available inside the Polygon: *7%*

| | | *Inside Custom Layer* | | | | | *Outside Custom Layer* | | | | | |
|---|---|---|---|---|---|---|---|---|---|---|---|---|
| **Unit Name** | **Unit Type** | **Time Spent In** (dd:hh:mm) | **Percentage** | **Miles Driven** | **# of Calls Assigned** | **Miles Driven on Assignment** | **Time Spent Out** (dd:hh:mm) | | **Miles Driven** | **# of Calls Assigned** | **Miles Driven on Assignment** | **Total Miles Driven** |
| Medic 1 | EMS | *0:23:59* | *99%* | *115* | *6* | *60* | *0:00:01* | *1%* | *2* | *0* | *0* | *117* |
| QRV 2 | EMS | *0:03:25* | *20%* | *30* | *5* | *21* | *0:20:35* | *80%* | *65* | *2* | *18* | *95* |
| E6 | Fire | *0:23:07* | *98%* | *18* | *4* | *14* | *0:00:53* | *2%* | *6* | *1* | *3* | *24* |
| Capt 5 | Fire | *0:08:33* | *26%* | *9* | *2* | *6* | *0:15:27* | *74%* | *21* | *1* | *6* | *30* |
| PD 4 | Police | *0:06:12* | *23%* | *55* | *9* | *36* | *0:17:48* | *77%* | *35* | *4* | *26* | *90* |

*FIG. 15*

SYSTEMS, METHODS AND APPARATUS FOR PROVIDING ENHANCED SITUATIONAL AWARENESS IN INCIDENTS

CROSS-REFERENCE TO RELATED APPLICATION

The present application claims priority to and the benefit of U.S. Patent Application 62/588,732 filed Nov. 20, 2017, the disclosure of which is hereby incorporated by reference in its entirety.

BACKGROUND

In incidents such as an emergency situation, every second can be critical in saving lives and property. A dispatcher receiving a call related to an emergency situation typically has to be ready to make life-saving decisions within a very short time, e.g., sometimes within a few seconds. The decisions of a dispatcher are communicated electronically to one or more first responders traveling via mobile emergency units to the location/scene of the emergency situation. First responders, mostly emergency medical services (EMS) providers, have contractual response time obligations (typically based on required standards) associated with a type of emergency situation. In addition, some first responders may have internal response time standards against which they evaluate their performance. Further, given a particular type of emergency situation, the maximum allowable time to respond to the emergency can vary depending on scene/location corresponding to the emergency situation. For example, a life-threatening emergency call in an urban area may have an 8-minute response time requirement. However, an emergency call that is not life-threatening and in an urban area may allow for a 10-minute response. A life-threatening emergency call in a non-urban area may allow for a 15-minute response time, whereas a non-life threatening emergency call in a non-urban area may allow up to a 20 minute response time. Thus, it is important to design robust emergency awareness tools that are not only cost-effective and compliant to industry standards, but also optimize response times depending on the environment or context of the emergency situation, thereby enabling first responders to arrive at the emergency scene in the shortest time possible.

BRIEF DESCRIPTION OF THE DRAWINGS

FIG. 6 illustrates an example screenshot showing calls awaiting assignment and their corresponding details depicted on an interface of the disclosed emergency response system.

FIGS. 7-8 illustrates example screenshots showing various details of a first mobile emergency unit assigned to an emergency situation depicted on an interface of the disclosed emergency response system.

FIG. 9 illustrates an example screenshot showing details of a second mobile emergency unit in close proximity to the first mobile emergency unit discussed in FIG. 8, depicted on an interface of the disclosed emergency response system.

FIG. 10 illustrates an example screenshot of a response time calculation performed by the disclosed emergency response system.

FIG. 15 illustrates example details of utilization of resources as part of a report depicted on an interface of the disclosed emergency response system.

DETAILED DESCRIPTION

Figure 1:
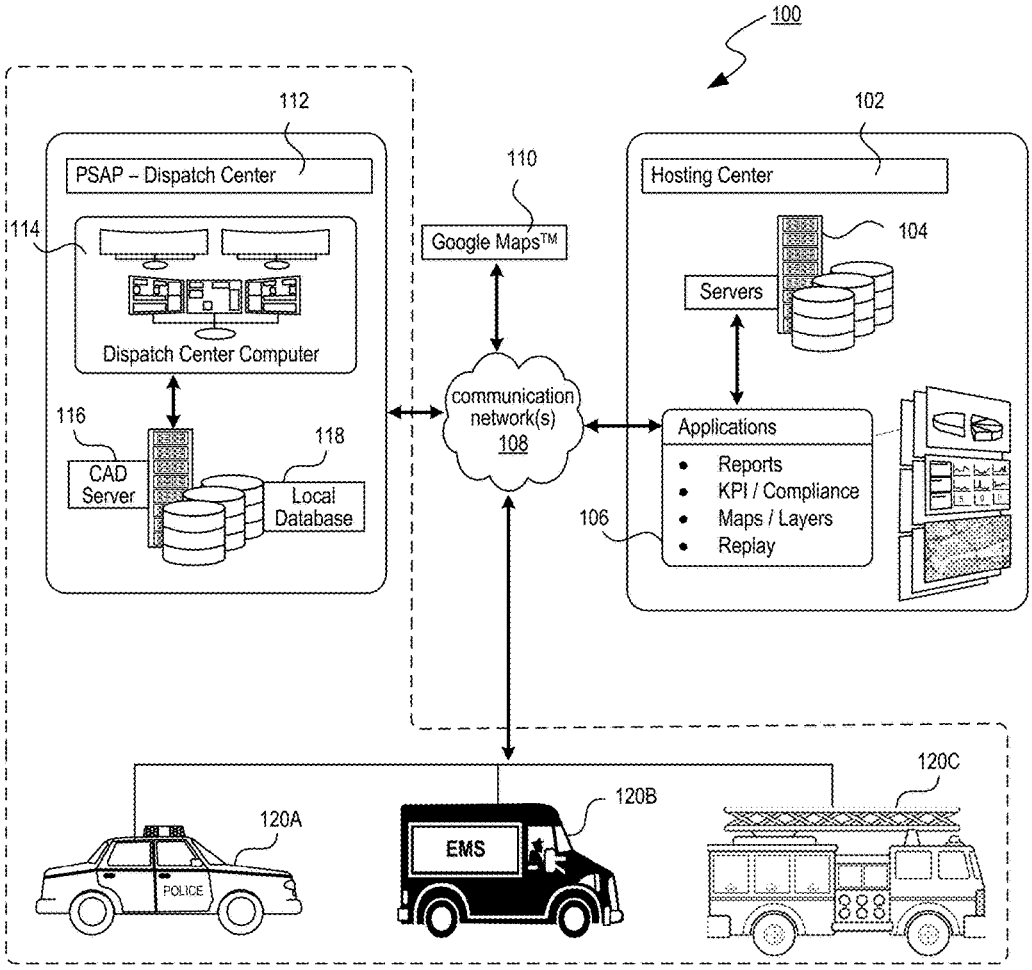
FIG. 1 illustrates an environment of operation of the disclosed emergency response system.

The following detailed description of the invention is merely exemplary in nature and is not intended to limit the invention or the application and uses of the invention. Furthermore, there is no intention to be bound by any particular theories or scenarios presented in the preceding background or the following detailed description.

The various embodiments described herein generally provide apparatus, systems and methods for enhanced situational awareness of dispatchers and/or first responders associated with responding to an emergency situation by assigning emergency units to a scene of an incident such as an emergency. As such, an emergency response system is disclosed. (The term, "first responder" is used synonymously herein as "emergency response agency" or "first responder agency.") In some embodiments, the disclosed emergency response system provides an electronic platform for collaboration or partnership involving two or more first responders. For purposes of discussions herein, a partnership is defined to be a resource-sharing collaboration between a primary first responder who first receives a call related to an emergency situation and one or more secondary first responders who may (or, may not be) assigned/deployed to the emergency situation. The primary first responder and the one or more secondary first responders share at least a portion of each other's for assignment to an emergency situation. This allows heightened situational awareness that results in assignment of the closest, fastest, or otherwise most appropriate, mobile or stationary emergency unit to respond to the emergency situation. A secondary first responder is one that receives information relayed by the primary first responder for responding to an emergency situation to which the primary first responder is unable to respond due to some reason. Examples of reasons can be terrain, weather, the secondary first responder having a mobile emergency unit that happens to be passing through the location of the emergency, or a stationary emergency unit of the secondary first responder that happens to be parked close to the location of the emergency, or any other reason which might require the need for resources from a secondary first responder. Indeed, it is contemplated that a first responder who is a primary first responder with respect to a given emergency situation may become a secondary first responder with respect to another emergency situation. Thus, the terms "primary" and "secondary" have no bearing on the capabilities of first responders. That is, given an emergency situation, the primary first responder is the one that first received notification of the emergency situation and relies on resources of one or more secondary first responders for assignment to the emergency situation. (The term "mobile emergency unit" broadly applies to any emergency vehicle or personnel, stationary or moving. Thus, tracking a mobile emergency unit can involve tracking mobile radios carried by personnel or in-vehicle radios.)

In some embodiments, the disclosed technology provides a first responder the option to restrict visibility (e.g., on a graphical user interface (GUI)) of certain types of information associated with the first responder's resources. In some embodiments, this visibility restriction can be applied to dispatchers of the first responder that are assigning the first responder's resources. In some partnership embodiments, this visibility restriction can be applied to dispatchers of a partner first responder with whom the first responder partners. By sharing a common baseline view of deployed resources, the disclosed technology allows a first responder to restrict visibility of shared resources with another first responder by defining a geographical boundary (also referred to herein as "a geofence"). Accordingly, a dispatcher of a first responder can only view (via the disclosed emergency response system) resources (e.g., emergency units on the ground, air borne, or water-based, equipment needed to address emergency situations, etc.) within the boundary set by the partner first responder. As used herein, the term "mobile emergency units" can refer to any type of vehicle traveling by land, air, or water. Further, emergency units are not necessarily restricted to motorized units and can include bikers, pedestrians, autonomous unmanned vehicles such as air borne drones, surface-based robots, underwater robots, and the like.

In partnership embodiments, the disclosed emergency response system may provide a ranked list of potential candidates that can be assigned to respond to an emergency situation. For example, the potential candidates can be mobile or stationary emergency units belonging to a first responder and/or its partner(s) first responders. These rankings may be based on an estimated time en route (ETE) that is representative of the time a respective candidate will take in arriving at the scene of the emergency situation.

The disclosed mobile emergency response system tracks in real-time (or, near real-time) the mobile emergency unit on a map displayed on a GUI (e.g., viewed by a dispatcher at dispatch center) of the disclosed emergency response system. Such tracking can be done for any mobile emergency unit, e.g., that is stationary or traveling. For example, a dispatcher at a dispatch center can view the mobile emergency unit on a map as it is on its way to respond to an emergency situation in conjunction with a representation of a response clock that is indicative of a maximum allowable time to respond to a given emergency situation. Such a representation can be based on any sensory feedback, e.g., colored circles, flashing lights, wailing sirens, or any other sensory feedback electronically produced.

FIG. 1 illustrates a representative environment 100 of operation of the disclosed emergency response system. In some embodiments, the disclosed emergency response system includes a server-hosted deployment (e.g., at hosting center 102) in conjunction with local database(s) 118 at a dispatch center 112. Dispatch center 112 includes one or more local databases 118, one or more CAD server(s) 116, and one or more dispatch center computers 114 showing information relating to resources 120A, 120B, 120. For example, one or more dispatch center computers 114 can be located in a control room at dispatch center 112. Dispatch center computers 114 can be the front-end components which are connected to back end components such as CAD server 116 coupled to one or more local databases 118. Hosting center 102 communicates with dispatch center 112 via one or more communication networks 108 (such as the Internet). For example, hosting center 102 can pull from/push to information relating to an emergency situation (in real time or near real time) from CAD server 116 and/or local databases 118 in dispatch center 112. For example, one or more computer-aided-dispatch (CAD) servers 116 coupled to one or more local databases 118 of the emergency response system can process information associated with the emergency situation for assigning resources, such as one or more mobile emergency units (e.g., units 120A, 120B, 120C) to the emergency situation. Dispatch center 112 can communicate with a mobile emergency unit via one or more communication networks 108 for tracking in real-time (or, near real-time) the location of a mobile emergency unit on a map displayed on a GUI (e.g., viewed by a dispatcher at dispatch center 112) of the disclosed emergency response system. Such tracking can be done for any mobile emergency unit, e.g., whether they are stationary or mobile. For example, in connection with FIG. 1, dispatchers in dispatch center 112 can view/track mobile emergency units 120A, 120B, 120C as they are assigned to respond to the same or different emergency situations. The disclosed emergency response system can generate the GUI that renders the tracking view to the dispatchers in dispatch center 112. An on-board GPS receiver, commonly referred to as automatic vehicle locator (AVL) located in a mobile emergency unit can report the location of the mobile emergency unit to hosting center 102 and/or dispatch center 112 for tracking purposes. In some embodiments, communications between the dispatch center 112 and the hosting center 102 are secured by an encryption algorithm (e.g., RSA algorithm). In some embodiments, dispatch center 112 can access external servers 110 (e.g., Google maps or Waze) for weather, live traffic, road closures, crash notifications, and other relevant information. In some embodiments, hosting center 102 can include one or more servers 104 that are configured to run one or more applications 106. Non-limiting examples of applications can be in connection with generating reports of emergency response, evaluating Key Performance Indicator (KPI)/compliance to industry standards, running one or more mapping applications, tracking live vehicular movement of mobile emergency units, displaying visual and numerical reports in the form graphs, analytics, emergency situation response-related metrics, or replaying historical movement of mobile emergency units. For example, the reports can include analytics based on one or more parameters of the call associated with the emergency situation including a date, a type of call and timeliness of response to call. For example, KPI/compliance applications can automatically detect compliance of the response and alert when violations occur. In some embodiments, applications 106 can integrate one or more third-party applications. In some embodiments, data relating to vehicular movement of mobile emergency units can be archived/stored at databases coupled with hosting center 102, in combination with (or, in lieu of) local databases 118 in dispatch center 112. In some embodiments, the hosting center can be remotely accessed (e.g., via a web-portal) for running one or more applications 106. Such accesses can be manual (e.g., requests by users of the disclosed emergency response system via a sign-in page) or electronic (e.g., requests by an application programming interface (API) communicatively coupled to the hosting center 112.)

The terms "first responder" or "first responder agency" or "emergency response agency," as used herein broadly apply to an entity designated or trained to respond to an incident such as an emergency situation. The entity can be related to law enforcement (police), military, fire, medical, paramedical, transportation, towing, railways, aviation, wreckage agencies, traffic agencies for traffic control, construction agencies, relief agencies (such as the World Health Organization or United Nations) or other suitable entities. Further, the above-mentioned terms also include the elements supporting the entity such as hardware infrastructure, software infrastructure, physical facilities, personnel, equipment, and vehicle fleet associated with the entity. As one example, the dotted bounding boxes in FIG. 1 and FIG. 2 indicate the components that can be owned and operated by these entities, and the general components that these terms can include. In some embodiments, in some jurisdictions, the above-mentioned terms apply solely to the emergency units, equipment, and the personnel associated with an entity.

It will be understood that although the discussions in FIG. 1 are in connection with one dispatch center that controls assignment of three mobile emergency units, such discussions are for illustrative purposes only. In alternate embodiments, there is no limitation on the number of dispatch centers and/or associated mobile emergency units. Furthermore, in different embodiments, the mobile emergency units can be for different types of first responders, e.g., law enforcement officials, medical units, fire units, paramedic units, tow trucks, or any type of first responder.

Figure 2:
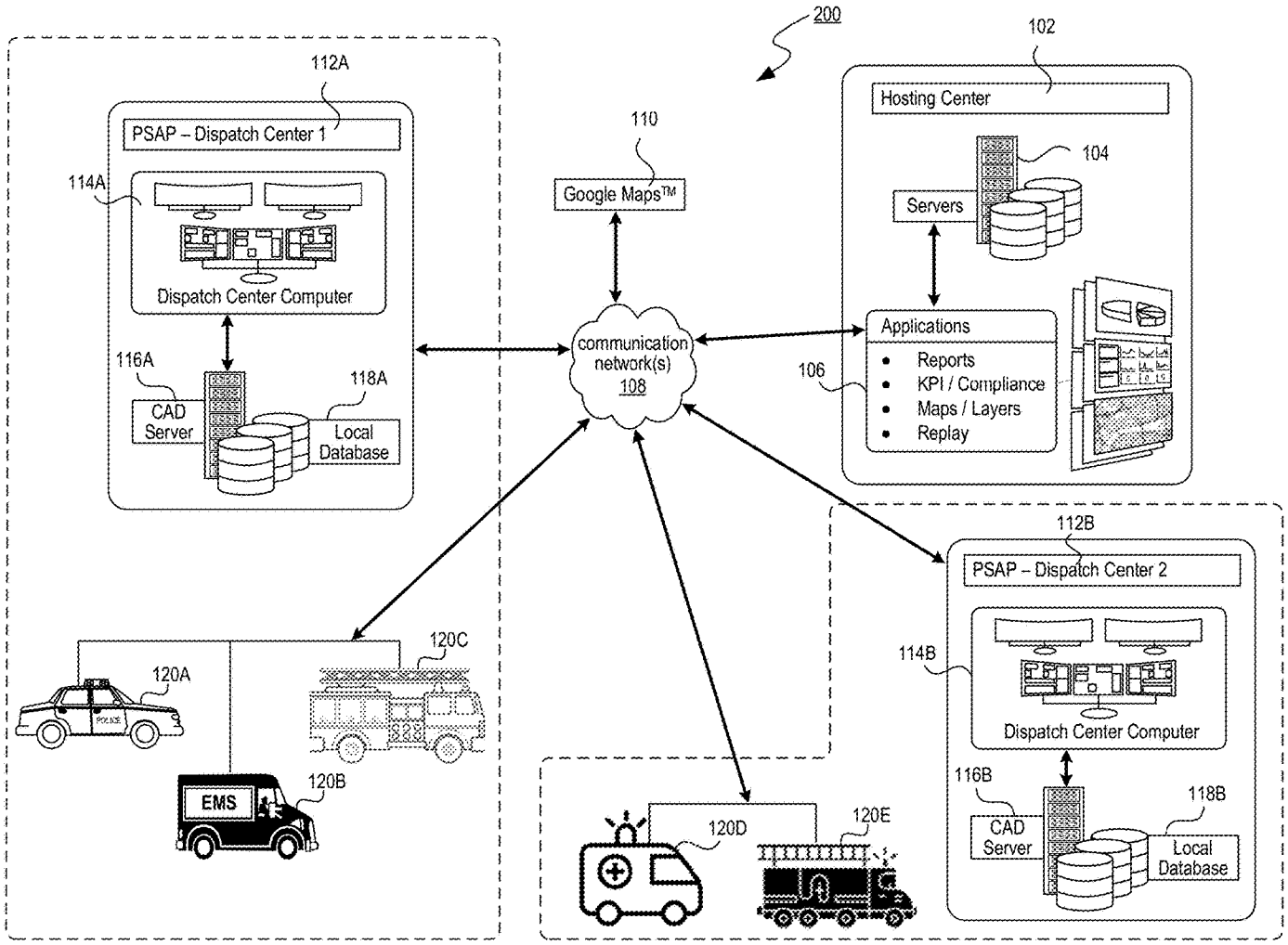
FIG. 2 illustrates another environment of operation of the disclosed emergency response system.

FIG. 2 illustrates another representative environment 200 of operation of the disclosed emergency response system. FIG. 2 shows dispatch center 1 (denoted 112A) and dispatch center 2 (denoted 112B) connected to the hosting center 102. Dispatch center 112A in FIG. 2 can be dispatch center 112 shown in FIG. 1. Dispatch center 112B may include similar components as dispatch center 112A, such as local database(s) 118B, CAD server 116B, and dispatch center computers 114B. FIG. 2 shows dispatch center 112B controlling the assignment of mobile emergency units 120D, 120E. FIG. 2 also shows that dispatch centers 112A and 112B may be configured to run the disclosed emergency response system.

In some embodiments, the disclosed emergency response system provides an electronic platform for collaboration or partnership involving two or more first responders. For purposes of discussions herein, a partnership is defined to be a collaboration in which a first responder shares (all or a portion of) its resources with other first responders.

With reference to FIG. 2, dispatch center 112A can belong to a different first responder than the first responder that owns and operates dispatch center 112B. For example, first responder A owns and operates dispatch center 112A and first responder B owns and operates dispatch center 112B. Accordingly, dispatchers in dispatch center 112A can view/monitor mobile emergency units 120A, 120B, 120C and dispatchers in dispatch center 112B can view/monitor mobile emergency units 120D, 120E. One or more benefits of partnership between first responders (such as first responder A and first responder B) can be better understood with the following illustrative example.

In a hypothetical scenario, dispatch center 112A of primary first responder A first receives a call for an emergency situation and secondary first responder B shares its resources (e.g., one or both mobile emergency units 120D, 120E) with first responder A. Also, it is assumed that mobile emergency units 120D, 120E are closer to the emergency situation location than any of mobile emergency units 120A, 120B, or 120C. Based on partnership between first responder A and first responder B, dispatch center 112A can assign any (or both) mobile emergency units 120D, 120E to respond to the emergency situation. By sharing the location of their respective mobile emergency units with one another, situational awareness is heightened, and ultimately the closest, fastest, or otherwise most appropriate mobile emergency unit can be assigned to respond to an emergency situation, regardless of potential response boundaries (e.g., contractual response areas or jurisdictional boundaries). This can be crucial in providing greater reliability in mission-critical, life-saving moments. Furthermore, for emergency situations that require cooperation among different first responders (e.g., law enforcement, medical, fire, etc.) knowing where all responding units are located at any moment in time can be extremely beneficial to allow for inter-agency cooperation.

It will be understood that although the discussions in FIG. 2 are in connection with one first responder collaborating or partnering with one another first responder, such discussions are for illustrative purposes only. In alternate embodiments, there is no limitation on the number of first responders that a given first responder can collaborate or partner with. Also, the first responders involved in a partnership/collaboration can be serving in geographically adjacent or geographically non-adjacent areas. For example, in some embodiments, partnerships between first responders in two countries are contemplated by the disclosed technology. In some embodiments, a partnership can be between different first responders or even different divisions/departments of the same first responder organization.

Although the discussions in FIG. 2 focus on dispatchers associated with the first responder monitoring or viewing the first responder's resources, in alternate embodiments, dispatchers associated with partnering first responders can track the resources of one another. In connection with FIG. 2, this would imply that dispatchers in dispatch center 112A can view/monitor mobile emergency units 120D, 120E and dispatchers in dispatch center 112B can view/monitor mobile emergency units 120A, 120B, 120C.

Additionally, although the example in FIG. 2 assumes that mobile emergency units 120D, 120E are assigned to the emergency situation location because of their proximity, in alternate embodiments, other factors besides proximity can be used in considering which emergency units to deploy. Non-limiting examples of such factors are health condition of the crew in a mobile emergency unit, situation-handling expertise/experience of the crew in a mobile emergency unit, quality/quantity of available supplies in a mobile emergency unit, condition of the mobile emergency unit, and the like.

Figure 3A:
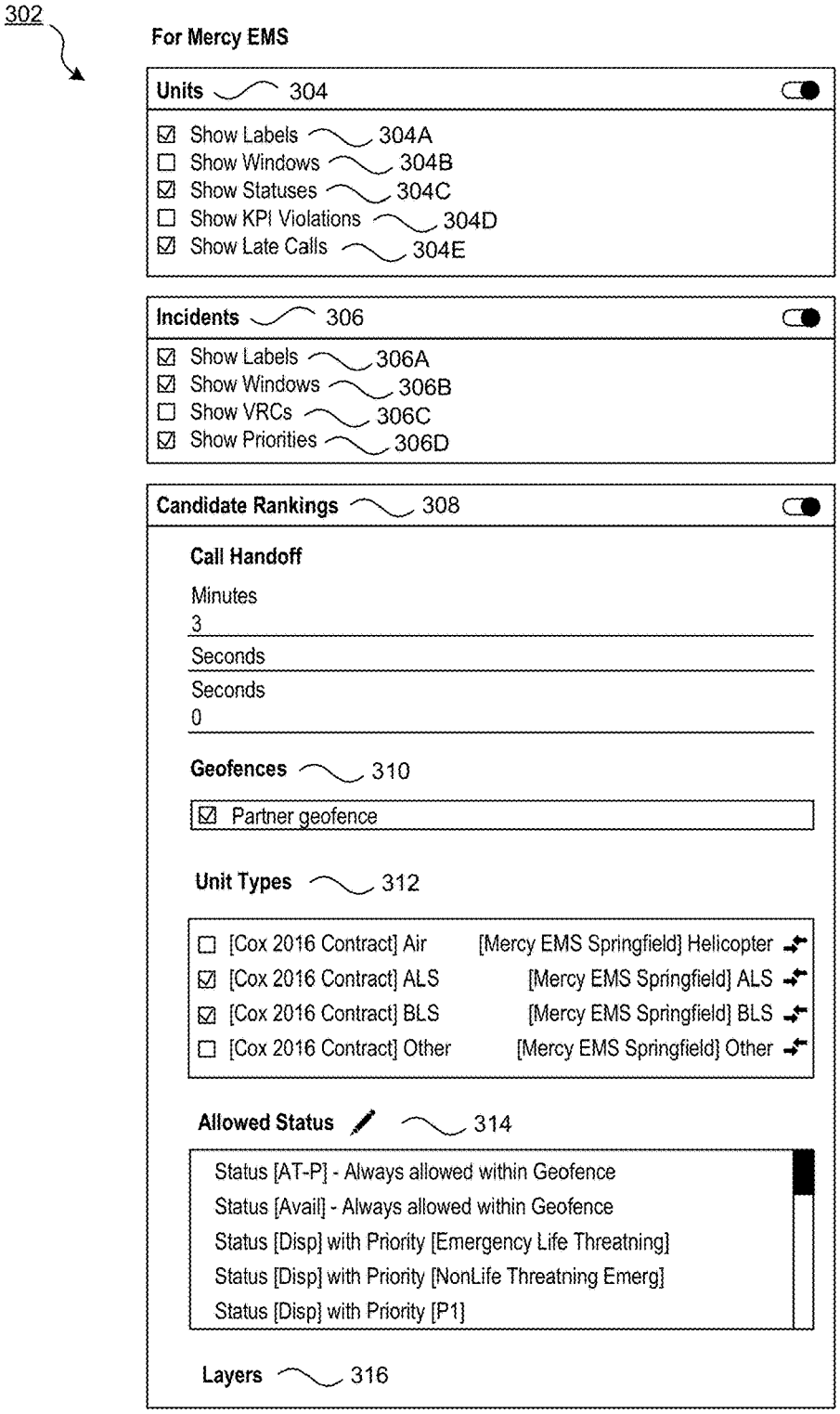
FIG. 3A illustrates an example screenshot showing information attributes visible to a dispatcher of a first responder and depicted on an interface of the disclosed emergency response system.

FIG. 3A illustrates an example screenshot showing information attributes associated with a first responder and depicted on an interface of the disclosed emergency response system. For purposes of the example in FIG. 3A, it is assumed that "Mercy EMS" is the first responder that partners with one or more other first responders.

In some embodiments, as shown in FIG. 3A, the disclosed technology provides a first responder agency the option to restrict visibility (e.g., on a graphical user interface (GUI)) of certain types of information associated with its resources. In some embodiments, this visibility restriction can be applied to dispatchers of the first responder that are assigning the first responder's resources. For example, region 302 in FIG. 3A shows attributes of information that are available/restricted for viewing on a GUI by a dispatcher associated with the first responder. A person with administrator privileges (e.g., a manager or owner of a first responder) can select (e.g., using toggle boxes or toggle buttons) a set of attributes of information that are available to be viewed by a dispatcher looking at vehicular information (e.g., mobile emergency unit information) windows associated with the first responder. In region 302, units section 304 includes toggle selections for showing attributes 304A ("Labels"), 304B ("Windows"), 304C ("Statuses"), 304D ("KPI Violations"), and 304E ("Late Calls"). A unit's label is an identifier for identifying a mobile emergency unit. A window of a mobile emergency unit provides additional information, such as unit type, crew member(s), speed of travel, status (enroute, at scene, at destination, etc.), destination address, incident number, priority of call, nature of call, assigning dispatcher, and other relevant information. A unit's status can be mobile emergency unit classification indicators such as available radio, dispatched, enroute, on scene, transporting, transport arrive, enroute to post, on post, and/or out of service. A unit's KPI violation indicates that a time threshold, established by the first responder agency has been exceeded. e g, a unit has been on scene longer than fifteen minutes or at the hospital offloading a patient longer than twenty minutes. A unit's late calls indicates that a maximum allowable response time standard has been exceeded, by response zone and/or by call priority. Thus, as illustrated in FIG. 3A, a dispatcher associated with a first responder may not necessarily see all the details of the first responder's resources associated with responding to emergency situations. In region 302, incidents section 306 includes toggle selections for showing attributes 306A ("Labels"), 306B ("Windows"), 306C ("Visual Response Clocks or VRCs"), and 306D ("Profiles). Visual Response Clocks are a representation of the maximum allowable time to respond to an emergency situation based on considering an average speed of travel of the mobile emergency unit to the location of the emergency situation. It helps dispatchers assess whether a mobile emergency unit will meet the response time requirement or not. The "Incidents" sections specify what items can be seen once a unit has been assigned to a call or incident. 'Show Labels' determines if a partner can see the radio ID of that unit. "Show windows" determines if the dispatcher can click on a unit and see additional information about that unit. "Show VRCs" determines if the visual response clock circles will be shown to the partner agency. "Show Priorities" determines if the partner agency can see the severity of the call.

In some embodiments, the disclosed technology generates a ranked list of first responders that can be potential candidates for assignment in responding to an emergency situation. In some embodiments, the candidate rankings are based on a call handoff time (e.g., a time to handoff a call relating to an emergency situation arriving at one first responder to another first responder). The rankings are calculated prior to handing the call off from one partner to another. The handoff time (e.g., a fixed time duration expressed in minutes) is typically entered/provided by the partner first responder. Details of candidate rankings are described in connection with FIG. 5. In region 302, candidate rankings 308 section allows toggling of viewing the rankings of potential candidates for assignment in responding to an emergency situation. The candidate rankings 308 section in FIG. 3A allows an administrator to enter the call handoff time. For example, the potential candidates can be mobile emergency units belonging to a first responder and/or its partner(s) first responders.

Geofence section 310 includes a toggle selection for setting up a geofence of a partner first responder. Details of a geofence created by one first responder for viewing by a partner first responder is described in connection with FIG. 4. Unit Type section 312 includes different types of units that are available to a dispatcher of Mercy EMS for assignment to an emergency situation. Examples of unit types can be helicopter, squad vehicle, advanced life support (ALS), bariatric life support (BLS), and other types of units. Allowed States section 314 in FIG. 3A includes statuses of mobile emergency units and their associated priorities provided by a first responder A that may be available for viewing by a partnering first responder B. For example, if a mobile emergency unit of first responder A has an "Available" status or "Enroute to Post" status, these units will be available to first responder B for assignment. However, for example, if a mobile emergency unit with an "Enroute" is assigned to a Priority 1 call for an emergency situation, that unit may not be displayed as available to first responder B. Region 302 also includes a layers section 316. In some embodiments, the present technology provides additional information for display on a map presented by a mapping application. Each layer can be turned on/off based on user selection. Different types of layers can be provided by embodiments of the present disclosure. Information relating to the different layers are described in greater detail in U.S. Pat. No. 9,646,498, issued May 9, 2017, which is incorporated by reference herein in its entirety.

In some embodiments, a first responder partnering with one or more other first responders can restrict visibility of details of partnership/collaboration attributes of shared resources that are available for viewing by dispatchers associated with the partner first responder(s). This allows a first responder to cherry-pick the attributes that the partner first responder is permitted to view. Such an embodiment is discussed in FIG. 3B.

Figure 3B:
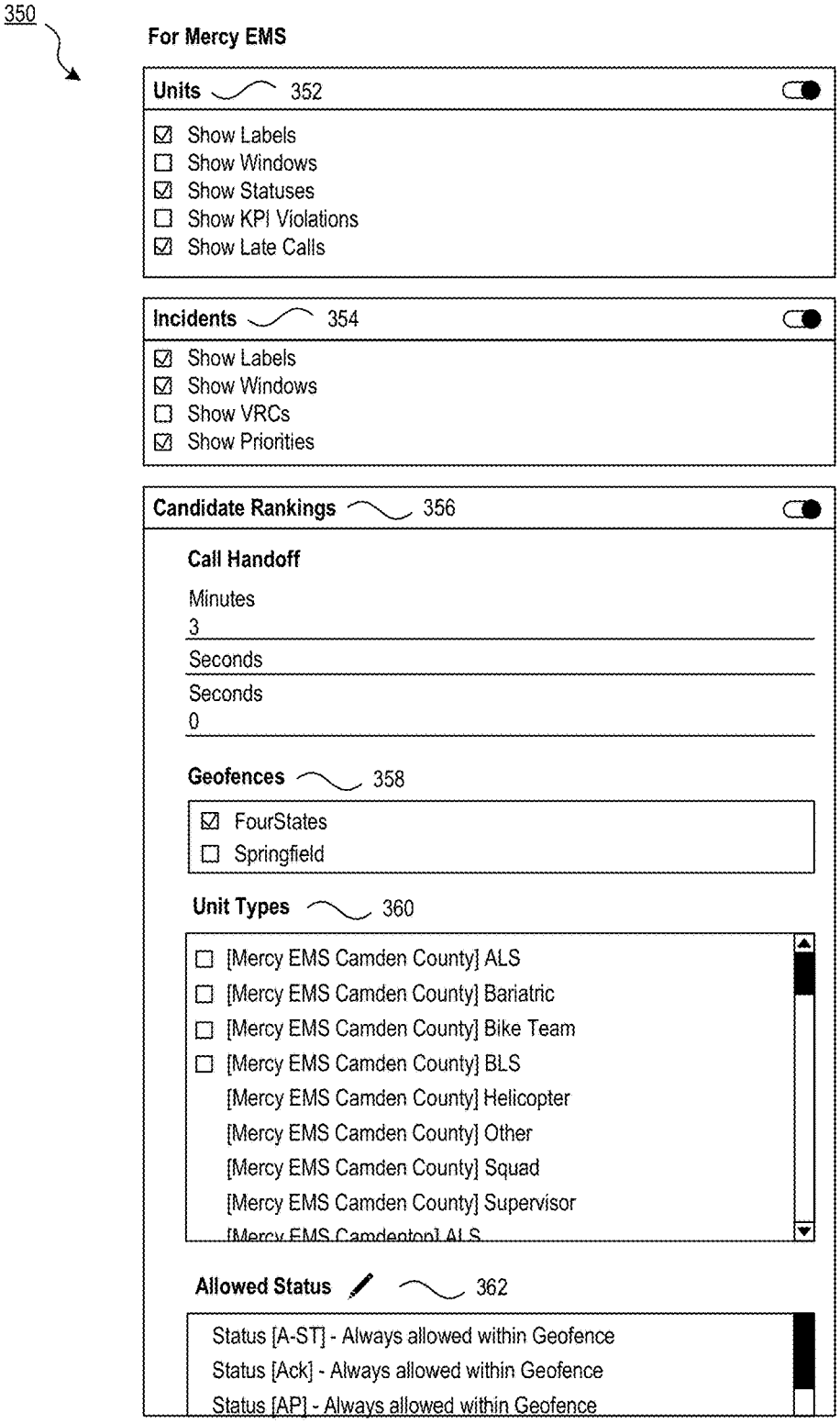
FIG. 3B illustrates an example screenshot showing information attributes visible to a dispatcher of a partner first responder and depicted on an interface of the disclosed emergency response system.

FIG. 3B illustrates an example screenshot showing information attributes associated with a first responder partnering with Mercy EMS and depicted on an interface of the disclosed emergency response system. Region 350 (displaying "from Mercy EMS") in FIG. 3 shows attributes of information that are available to be viewed by a dispatcher associated with the partner first responder. Thus, for example, a person with administrator privileges (e.g., a manager or an owner of Mercy EMS) can determine and select which information attributes are available to be viewed by a dispatcher associated with a first responder partnering with Mercy EMS.

In region 350, units section 352 includes toggle selections for showing the following attributes: "Labels," "Windows," "Statuses," "KPI Violations," and "Late Calls." The meaning of these attributes has been discussed previously in connection with unit section 304 in FIG. 3. In region 350, incidents section 354 includes toggle selections for showing incidents attributes which have been discussed previously in connection with incidents section 306 in FIG. 3. Region 350 in FIG. 3 includes a "Candidate rankings" section 356. Region 350 in FIG. 3 includes a geofences section 358. For example, geofences section 358 includes FourStates and Springfield as the name of the geofences that are created by Mercy EMS. A first responder partnering with Mercy EMS can only view the resources of Mercy EMS within a geographical area defined by the geofence. Allowed States section 360 in region 350 includes statuses of mobile emergency units and their associated priorities provided by a first responder A that may be available for viewing by a partnering first responder B. Region 350 in FIG. 3 includes layers section 362 which is discussed previously and described in greater detail in U.S. Pat. No. 9,646,498, issued May 9, 2017, which is incorporated by reference herein in its entirety.

Regions 356, 358, and 360 are shown grayed out on the interface in region 350. This indicates that a dispatcher associated with a partner of Mercy EMS cannot edit or change the attributes included in the grayed-out portions. It will be understood that the collaboration attributes shown in reference to FIG. 3A and FIG. 3B are for illustrative purposes only. In alternate embodiments, there is no limitation on the number or type of collaboration attributes that define partnership involving two or more first responders. Furthermore, there is no restriction on the number and type of resource attributes for selective viewing by dispatchers associated with a first responder and/or its partners.

Figure 4:
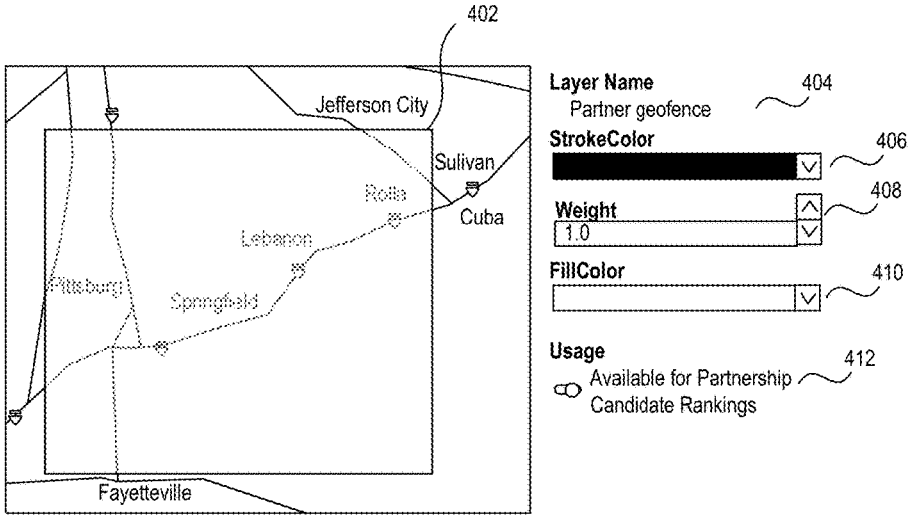
FIG. 4 illustrates an example screenshot showing a geofence associated with partnerships for sharing of resources between two first responders depicted on an interface of the disclosed emergency response system.

FIG. 4 illustrates an example screenshot showing a geofence associated with partnerships for sharing of resources between two first responders depicted on an interface of the disclosed emergency response system. In some embodiments, the disclosed technology allows a first responder to restrict visibility of shared resources to a partnering first responder by defining a geographical boundary (a/k/a a geofence). Accordingly, a dispatcher of a first responder B partnering with another first responder A can only view the resources of first responder A within a geographical area defined by the geofence set up by first responder A. In some embodiments, a dispatcher of a first responder B partnering with another first responder A can be allowed to see all first responder A resources if no geofence is established. In instances where a geofence is established and first responder A's unit is outside of the established geofence but is assigned to a call inside the geofence, first responder A's unit can be visible to first responder B until first responder B is no longer assigned to the event or reaches a non-allowed state.

For example, FIG. 4 includes a geofence 402 overlaid on a map. An administrator creating the geofence can specify a name, a line color, a weight of the line, and a fill color in regions 404, 406, 408, and 410 respectively. In some embodiments, a first responder has the option to include the geofence(s) of its partner(s) in determination of partnership candidate rankings. Such an option can be selected on the interface by clicking on toggle button 412.

For example, a police partner agency may only allow an EMS partner agency to see the locations of their patrol units when the patrol units are en route and when the patrol units are at the scene of the incident. At other times, the police partner agency may not allow their patrol units to be visible to the EMS partner agency. Also, the police partner agency may choose to always hide the locations of the SWAT and detective units. Thus, complete visibility, selective visibility, or non-visibility of resources of first responders may depend on one or more criteria such as a type of agency, an availability status, a priority of an emergency situation, a type of first responder, and the like. A partner agency may also set complete visibility, selective visibility, or non-visibility based on creating a geofence.

In some scenarios, outside of geofence 402, it is possible that individual assignments/operations by a first responder agency can occur without its partner agencies being aware of such assignments/operations.

Figure 5:
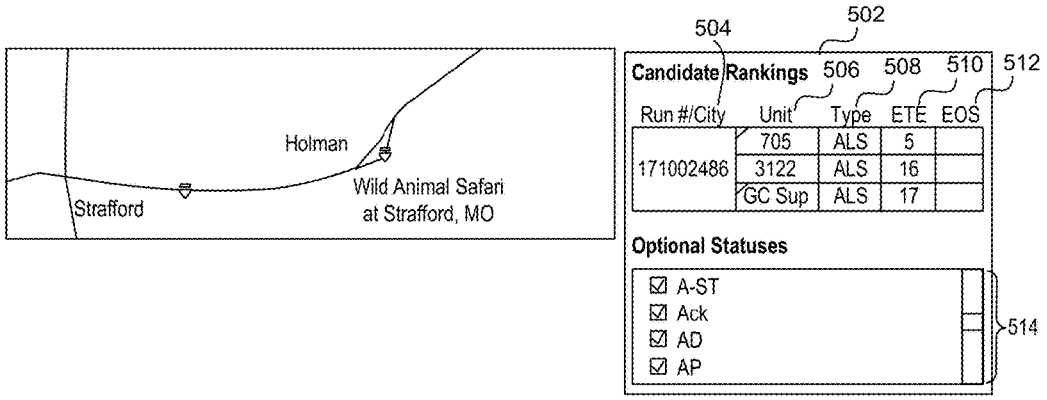
FIG. 5 illustrates an example screenshot showing a ranked list of candidate collaborators of a first responder depicted on an interface of the disclosed emergency response system.

FIG. 5 illustrates an example screenshot showing a ranked list of candidate partners/collaborators of a first responder depicted on an interface of the disclosed emergency response system. The ranked list of candidate collaborators indicates potential candidates for assignment in responding to an emergency situation. For example, the potential candidates can be mobile emergency units belonging to a first responder and/or its partner(s) first responders. Based on the candidate rankings, a dispatcher of a first responder can determine which emergency response unit(s) to assign to a given emergency situation. The ranked list of candidate collaborators in FIG. 5 includes several columns. For example, the columns include a run identifier 504, a mobile emergency unit identifier 506, a mobile emergency unit type 508, an estimated time enroute (ETE) 510, and an EOS identifier 512. Run identifier 504 is an identifier for an emergency situation. Mobile emergency unit identifier 506 is a candidate unit that can be potentially assigned to the emergency situation. Estimated time enroute (ETE) 510 is an estimate of a time that a respective candidate will take in arriving at the scene of the emergency situation. EOS identifier 512 indicates End-of-Shift time (e.g., scheduled off-duty time). In some embodiments, candidate rankings can also display optional statuses "At Station (A-ST)," "Acknowledged (ACK)," "At Destination (AD)," or "At Post (AP)" as shown in region 514.

In FIG. 5, the triangles displayed in mobile emergency unit identifier column 506 indicate that units "705" and "GC Sup" are 'partner' mobile emergency units. When a dispatcher viewing the rankings hovers a mouse over the red triangles, the interface would show the dispatcher which first responder the partner unit belongs to. Accordingly, the call to respond to the emergency situation can be handed off to the partner if necessary. Call handoff can be set by a first responder that receives a call relating to an emergency situation. The call handoff time indicates how long it typically takes to process (e.g., based on call intake guidelines) a call at its end and then send to another first responder.

In some embodiments, the rankings are based on the value of estimated time enroute (ETE) for a mobile emergency unit of a partner. The value of ETE for a mobile emergency unit automatically factors in the call handoff time for handing off the call from one responder to another. Thus, the mobile emergency unit of a partner that has the lowest ETE will be ranked at the top in the list. In some embodiments, more than one emergency unit of the same partner can be included in the candidate rankings, based on the ETE values of those units from the scene of the emergency situation.

FIG. 6 illustrates an example screenshot showing calls awaiting assignment and their corresponding details depicted on an interface of the disclosed emergency response system. A summary as shown in FIG. 6 can be used to monitor response to emergency situations, determine what resources are tied up, determine what resources are available, or perform any type of an overall assessment of the first responder's resources. FIG. 6 shows a list of scheduled calls in queue, non-emergent calls that are pending awaiting a specific pick-up time. Details of the information displayed in the screenshot are explained below.

Each row in FIG. 6 is indicative of a task in which an ambulance/EMT is scheduled to pick up a patient from a specified location, dropping the patient off at a medical facility, picking up the patient from the medical facility, and returning the patient back to his/her home location. The location can be home, a doctor's office, hospital, etc. When icon 601 is clicked, the interface reveals a geographical route that the mobile emergency unit can take from pick-up at the patient's home location to arrival at the medical facility. Will Call column 602 indicates if the medical facility is supposed to call the dispatch center indicating when the patient is ready for pick-up. Date/time column 604 indicates a date and a time of pick-up. Trip column 606 indicates a first responder-specific identifier of a trip pertaining to the emergency situation. Average task time column 608 indicates a historical (e.g., over the past thirty calls) average of the total time spent in pick-up and drop-off by a respective EMT/ambulance provider for a given pair of pick-up and drop-off locations. The average task time enables dispatchers to make better, more informed decisions as to which mobile emergency unit (e.g., whether its own or its partner(s)) to assign and for what pick-up/drop-off locations. For example, based on the average task time a dispatcher can identify the top two or three ambulance/EMT providers for a certain pair of pick-up drop-off locations, and accordingly send one of the providers in the top two or three providers. Priority column 610 indicates a level of priority associated with the task. Chief complaint column 612 indicates the main complaint associated with the task. Columns 614, 616, 618, and 620 indicate the patient's pick-up location/city and drop-off location/city. Column 622 indicate notes/instructions specific to a task that may be available from the partner first responder and/or the medical facility. Although the discussions in FIG. 6 are associated with tasks of pick-up and drop-off of patients, in alternate embodiments, the tasks can relate to responding to other types of emergency situations.

FIGS. 7-8 illustrate example screenshots showing various details of a first mobile emergency unit assigned to an emergency situation depicted on an interface of the disclosed emergency response system. Such details can be viewed by a dispatcher in determining particulars of emergency response unit(s) assigned to a given emergency situation. For example, FIG. 7 indicates a mobile emergency unit (with identifier #703) that is an ALS-type unit, having a vehicle id 1804, traveling at 4 mph, and is at the scene of the emergency location. In some embodiments, the disclosed system tracks in real-time the mobile emergency unit on a map displayed on a GUI (e.g., viewed by a dispatcher at a dispatch center). When the dispatcher clicks on the mobile emergency unit icon displayed on the GUI, additional details of the unit are displayed, e.g., via a drop-down menu on the GUI. The interface also indicates button 708 that provides information about other emergency units that are located close to unit 703. When button 708 is clicked, the interface shown in FIG. 8 is displayed. Region 804 in FIG. 8 indicates a ranked list (based on ETE values) of two other units (unit #706*a* and unit #701) located close to unit #703. Region 802 in FIG. 8 indicates an incident # and a time corresponding to the emergency situation. Region 806 in FIG. 8 indicates a priority level (e.g., P1) of the emergency situation and a short descriptor (e.g., cardiac arrest/health) of the emergency situation. The chief complaint determines the priority, but they can also be independently set. For example, a cardiac arrest call of an expected death (e.g., of a hospice patient) could result in a Priority 3 (P3) response versus a Priority 1 (P1) of a sudden cardiac arrest patient. Upon clicking on unit 706*a* identified in region 804, additional details of unit 706*a* are displayed, as shown in FIG. 9.

FIG. 9 illustrates an example screenshot showing details of a second mobile emergency unit in close proximity to the first emergency unit discussed in FIG. 8, depicted on an interface of the disclosed emergency response system. Such details can be viewed by a dispatcher in determining particulars of emergency response unit(s) in close proximity to an emergency response unit that is already assigned to a given emergency situation. As shown in FIG. 8, the first emergency unit is identified as unit #703 and the second emergency unit is identified as unit #706*a*. Additional details of unit #706*a* are displayed in FIG. 9. For example, region 902 in FIG. 9 indicates that unit #706*a* is an ALS-type of unit, identified by vehicle is 1809, traveling at 0 mph, a status stating that it is located at the post, and the crew members that are associated with unit #706*a*. Region 904 indicates information resulting from clicking on the scene target as shown in FIG. 7 and then clicking "Get Closest Units" which will display the three closest/fastest units to the incident location. In FIG. 9, clicking on a unit and then clicking 'Get Closest Units' will show the closest/fastest three mobile emergency units in proximity to that unit.

FIG. 10 illustrates an example screenshot of a response time calculation performed by the disclosed emergency response system for a representative mobile emergency unit. Typically, in emergency response applications, the effectiveness of the response to an emergency situation can be measured by several parameters known in the art. According to disclosed embodiments, one such parameter is called "chute time" or "turnout time." In some embodiments, e.g., as shown in FIG. 10, the chute time can be expressed as a combined collection of three (3) time parameters that are recorded or calculated. The three parameters include a "Button Push" parameter, a "1$^{st}$ AVL Update" parameter, and a ">50 m Update" parameter.

The Button Push parameter indicates a duration of time between (i) a first time instant when a mobile emergency unit is assigned to respond to an emergency situation and (ii) a second time instant when a crew member in the assigned mobile emergency unit presses a button (e.g., in their vehicle or on their mobile device) that is communicatively linked back to the CAD server at the dispatch server, which accordingly identifies a status of the mobile emergency unit enroute to the emergency situation. In short, the first time instant is called the Dispatch time and the second time instant is called as the Enroute time. Thus, the Button Push can be calculated as the Enroute time minus the Dispatch time. For example, based on the exemplary data for mobile emergency unit 820, the Button Push in FIG. 10 is 5 seconds after being assigned, they indicated they were enroute via a button push.

The 1$^{st}$ AVL Update parameter indicates a duration of time between (i) the Dispatch time and (ii) the first time instant when a valid position of the mobile emergency unit is received by the on-board GPS modem located in the mobile emergency unit. For example, based on the exemplary data for mobile emergency unit 820, the 1$^{st}$ AVL Update in FIG. 10 is recorded at 00:00:14.

The >50 m Update parameter indicates (i) a duration of how long it took a mobile emergency unit to travel at least 50 meters after being assigned to respond to an emergency situation and (ii) a distance of how far beyond 50 meters has the mobile emergency unit traveled when the disclosed emergency response first captures the position of the mobile emergency unit. For example, based on the exemplary data for mobile emergency unit 820, the >50 m Update is recorded at 52 meters at 00:01:11. Thus, the unit's chute time was greater than one minute for this response as opposed to the five seconds to get enroute as the button push indicated. The >50 m Update parameter is for illustrative purposes only. In alternate embodiments, any suitable threshold parameter can be used.

Figure 11:
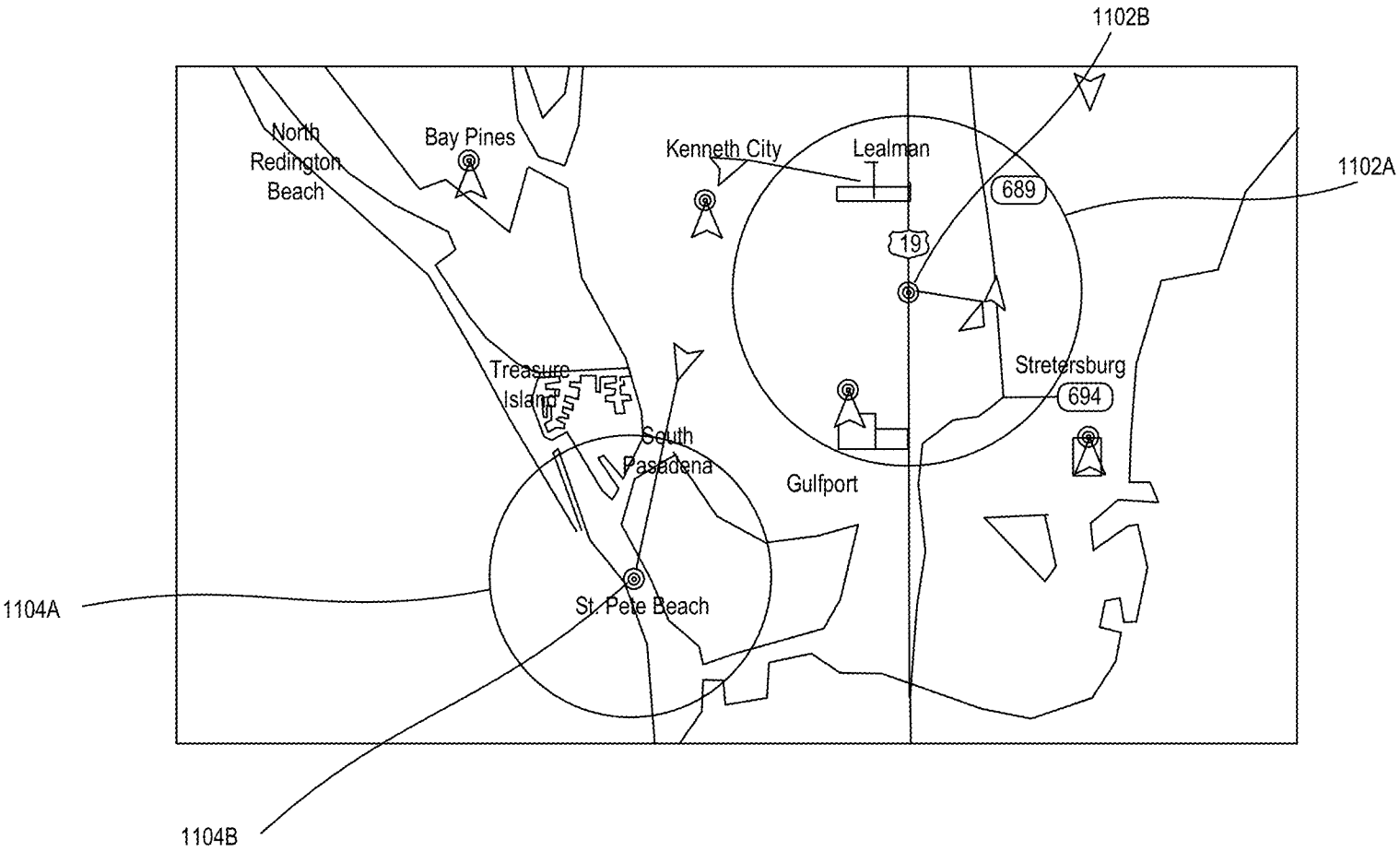
FIG. 11 illustrates an example screenshot of a visual representation of a response clock in connection with responding to an emergency situation depicted on an interface of the disclosed emergency response system.

FIG. 11 illustrates an example screenshot of a visual representation of a response clock in connection with responding to an emergency situation depicted on an interface of the disclosed emergency response system. In some embodiments, the disclosed system tracks in real-time (or, near real-time) the mobile emergency unit on a map displayed on a GUI (e.g., viewed by a dispatcher at a dispatch center) of the disclosed emergency response system. Such tracking can be done for any mobile emergency unit, whether stationary or mobile. For example, a dispatcher at a dispatch center can view the mobile emergency unit on a map as it is on its way to respond to an emergency situation in conjunction with a representation of a response clock that is indicative of a maximum allowable time to respond to a given emergency situation.

The response clocks allow personnel (e.g., dispatchers at dispatch centers and/or crew on a mobile emergency unit) associated first responders to assess whether a mobile emergency unit will meet the response time requirement or not, based on the relative proximity of the mobile emergency unit to the innermost/outermost concentric circle. For example, if the location of the mobile emergency unit is closer to the outermost circle than the innermost circle, then it might be more difficult for the mobile emergency unit to meet the response time requirement. The response clock is calculated based on an average speed of the mobile emergency unit. The average speed depends on the type of travel of the mobile emergency unit. Examples of types of travel can be driving, walking, bicycling, flying by helicopter, etc. The average speed can be configured by settings on a user-interface (e.g., shown in FIG. 12). The initial size of the clock (e.g., represented visually as the outermost circle) corresponds to a maximum allowable response time for the emergency situation and the average speed. In some embodiments, maximum allowable response time for the emergency situation is based on a priority of the emergency situation. As long as the maximum allowable response time has not elapsed, and the mobile emergency unit travels towards the innermost circle (e.g., the location of the emergency situation), the size of the outermost circle continues to constrict until the mobile emergency unit arrives at the location. If, however, the maximum allowable response time for the emergency situation elapses before the mobile emergency unit arrives at the location, then the outermost circle disappears. The map allows zooming in and out to view the environment around the mobile emergency unit, or the scene of the emergency situation. In some embodiments, the ratio of the size of the outermost circle to the size of the innermost circle is invariant of zooming in or out of the map.

In some embodiments, the visual representation of a response clock is indicated with the help of a circle with the center of the circle representing the location of the emergency situation on a map. For example, circles 1102A and 1104A in FIG. 11 indicate representations of response clocks in connection with the time remaining to respond to two different emergency situations at locations 1102B and 1104B respectively. In some embodiments, the circles can be animated. For example, the circle can be shown to be gradually constricting (into concentric circles) as the time to respond to an emergency situation decreases. Thus, in FIG. 10, the time remaining for responding to the emergency situation at location 1104B is shorter than the time remaining for responding to the emergency situation at location 1102B. In some applications, the circles can be colored. For example, the color of the colored circle (and/or the center of the circle) may correspond to a color of the mobile emergency unit assigned to respond to the emergency situation or a color indicative of priority of the emergency situation. For example, red may indicate the highest priority followed by medium and low priority situations shown in amber and green colors. According to disclosed embodiments, there is no limitation on the color and/or the number of concentric circles that may be displayed in connection with a visual response clock. Further, other suitable geometric shapes and/or indicators (visual or audible), besides circles, may be utilized to show a time remaining to respond to an emergency situation, without departing from the present disclosure. Also, the response clock can be represented by other means of feedback besides visual feedback. For example, such feedback can be based on any type of sensory feedback involving tactile, video, audio, or any combination of the above.

Figure 12:
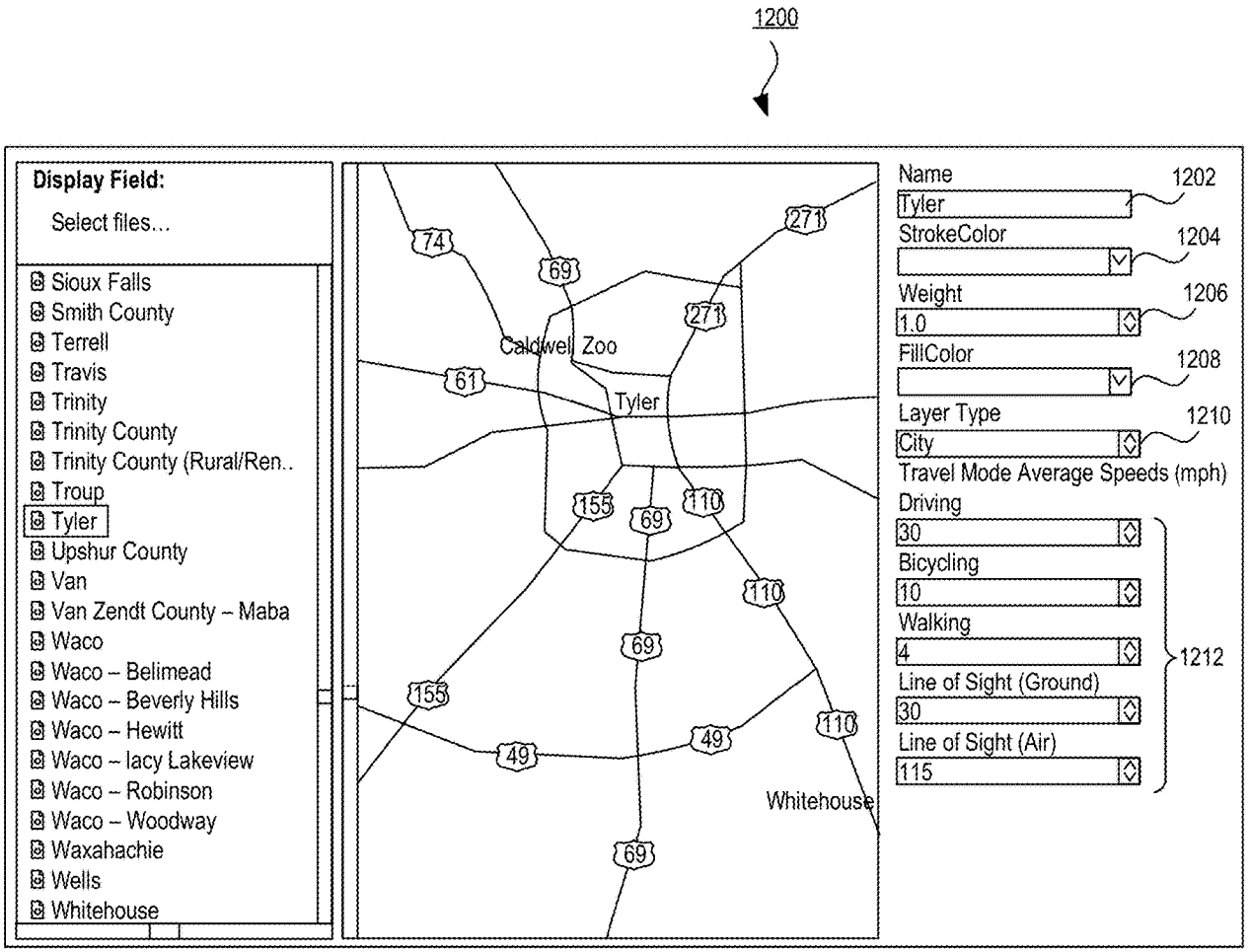
FIG. 12 illustrates an example screenshot of configuration settings for generating the visual representation of the response clock discussed in FIG. 10 depicted on an interface of the disclosed emergency response system.

FIG. 12 illustrates an example screenshot 1200 of configuration settings for generating the visual representation of the response clock discussed in FIG. 10 depicted on an interface of the disclosed emergency response system. These configuration settings can be entered or selected by a user interacting with the interface. In FIG. 12, interface 1200 includes a name (1202) of a geographical region where the clock is to be displayed, a color (1204) of the geographical region, a weight (1206) of the line used for displaying the clock, a fill color (1208) of the geographical region, a type (1210) of a geographical region, and a speed/type (1212) of travel of the mobile emergency unit. The "Layer" field is a free-text field established by the first responder which can be city, county, urban, suburban, wilderness, etc. and does not necessarily have any connection with the VRC or how it operates. A first responder can configure the response clock for different geographical regions or different types of emergency situations. Also, the response clock can be configured differently by different first responders. In some embodiments, a first responder can choose to display the response clock for high priority emergency situations only, and not for all emergency situations. Thus, an advantage of the disclosed response clock is that it is adaptable for different first responders, different geographical regions, different types of mobile emergency units, or different emergency situations. The configuration settings shown in FIG. 12 are for exemplary purposes only. Various other settings of the response clock can be contemplated in alternate embodiments without departing from the scope of the disclosure.

Figure 13:
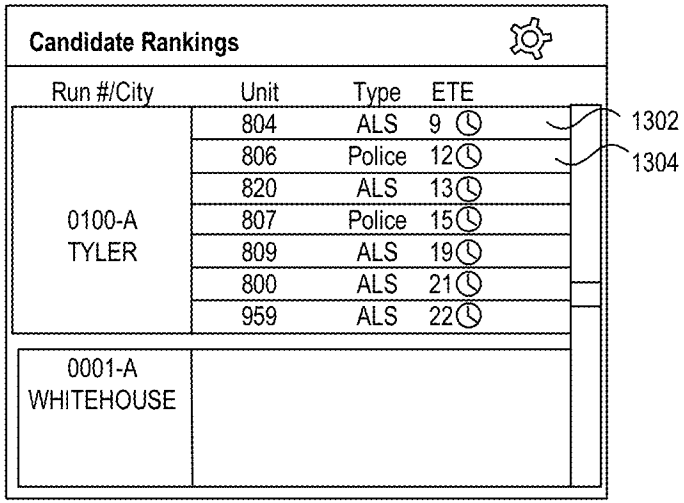
FIG. 13 illustrates a ranked list of first responders that can be potential candidates for assignment in responding to an emergency situation depicted on an interface of the disclosed emergency response system.

FIG. 13 illustrates a ranked list of first responders that can be potential candidates for assignment in responding to an emergency situation depicted on an interface of the disclosed emergency response system. In some embodiments, these ranks are displayed to the primary first responder, i.e., the emergency response agency who first receives a call related to the emergency situation. In some embodiments, these ranks are displayed to the primary first responder and the partnering first responder agency. For example, a cloud-based server pulls the call data from the primary first responder, calculates the rank, and causes the rank to be displayed at a dispatch station of the primary first responder and/or the dispatch station(s) of partnering first responders. Calculation of the ranks depend on the (instantaneous or near-instantaneous) locations of the emergency units. Thus, the server calculating the ranks receives information relating to the locations of the emergency unit(s) periodically or intermittently. In some embodiments, the ranks are calculated on the basis of increasing values of ETE of individual emergency units (stationary or mobile), from the scene of the emergency situation. Thus, an emergency unit A having lower ETE than an emergency unit B is ranked higher in the list. In FIG. 13, line 1302 indicates that unit 804, which is an ALS type of a unit, is ranked highest because its estimated time en route (ETE) is 9 minutes, which is the lowest ETE among all units in the list. The second ranked unit is unit 806, which is a police (law enforcement) type of a unit, having an ETE of 12 minutes to arrive at the emergency situation. In some embodiments, the rankings are limited to a given geographical region. For example, in FIG. 13 the rankings are limited to the city of Tyler in Texas. Because the locations of emergency units can change instantaneously, there is no limitation to the number of times that the ranking algorithm can be run.

Figure 14A:
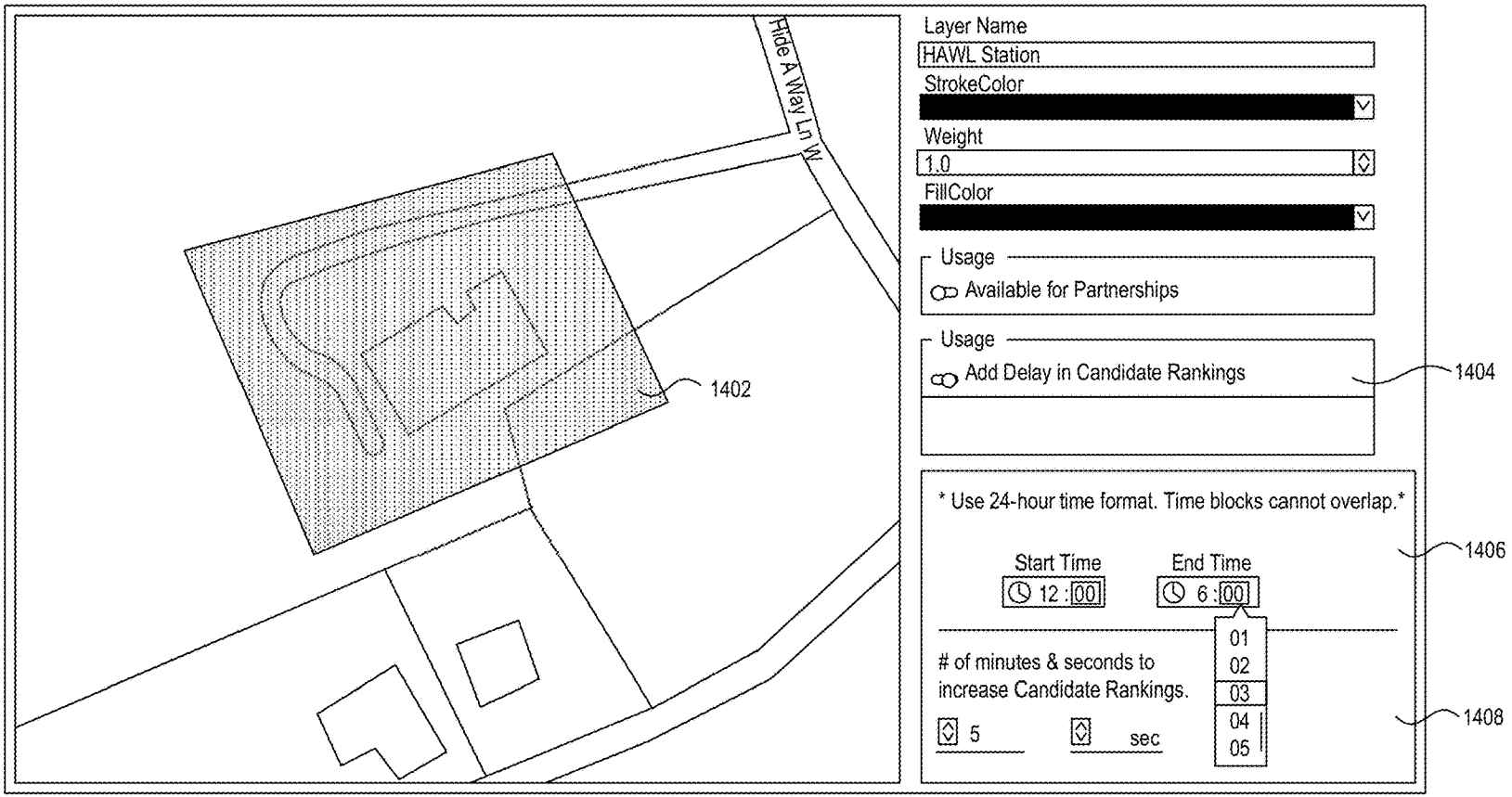
FIGS. 14A, 14B illustrate custom layers drawn on a map depicted on an interface of the disclosed emergency response system.
Figure 14B:
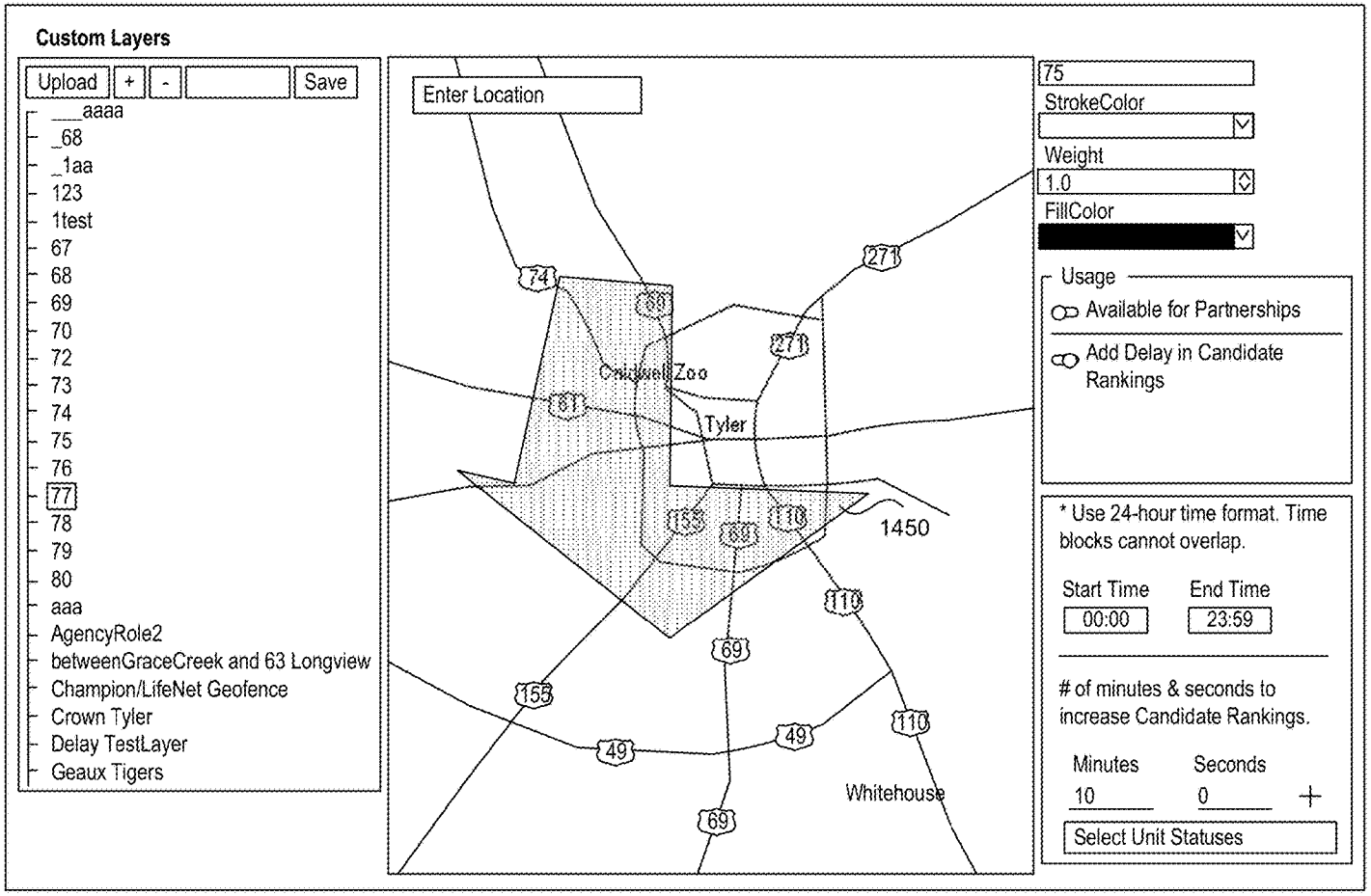

FIGS. 14A, 14B illustrate custom layers drawn on a map depicted on an interface of the disclosed emergency response system. A custom layer is associated with a visual representation of an area (e.g., a polygon) drawn on a map for indicating a criterion or condition of a resource (e.g., an emergency unit) located (traveling or stationary) inside the area. The custom layer is termed "custom" as it can be drawn (customized) by a first responder who owns the resource or, partners the resource with another first responder. In the examples shown in FIGS. 14A, 14B the custom layers are shaded areas and the criterion is a value of a delay added to the response time of one or more emergency response units located within the shaded area. The value of the delay is factored in by the system for calculating ranks of emergency units that are deployable at a given emergency situation. The ranks can be calculated in accordance with a time to arrive at the emergency situation. In FIG. 14A, the shaded area 1402 is a custom layer drawn on a map by personnel of a first responder. In conjunction with drawing the shaded area 1402 on the map, the personnel can also select (using up-down arrows) a value of the delay (in region 1408) and a time of delay when the delay is proposed, e.g., in the form of a start time/end time (shown in region 1406). In some embodiments, the shaded area can be drawn around a facility, e.g., a fire station or a hospital where emergency response units are parked. As a fire station example, considering that fire fighters can be sleeping at the fire station between midnight and 6 AM, it can take up to 5 minutes for them to be alerted about a fire emergency, get ready, and leave enroute to the scene of the fire. This (estimated) 5-minute delay is factored in for purposes of calculating candidate rankings of preparedness of response of the fire station. Hence, it will be appreciated that disclosed embodiments provide the advantage of factoring realistic considerations/conditions in choosing which responder(s) to deploy at an emergency situation. Thus, in FIG. 14A resources (mobile or stationary) located within shaded area 1402 are subjected to a 5-minute delay in response between the 00:00 hours and 6:00 hours. In addition to choosing the value of the response delay and the date/time when the delay condition is proposed, the first responder personnel can click on toggle button (shown in region 1404) to select whether or not the delay can be used in calculating candidate rankings to ascertain ranks of resources deployable at the emergency situation. (These resources can belong to the primary first responder or partnering first responder.) Region 1404 also shows a toggle button for the personnel to select whether or not the delay is to be used for purposes of partnerships with other first responders. FIG. 14A also shows that the interface provides options to choose a name, a weight of the line for drawing the area corresponding to the custom layer, and a fill color of the area. Although FIG. 14A demonstrates that the "custom layer" is associated with the response delay criterion, in alternate embodiments, various other criteria can be associated with the "custom layer." Examples of criteria can be a status (enroute, at scene, at destination, etc.) of an emergency unit, a type of an emergency situation (fire, EMS, law enforcement, etc.), a type of a resource (e.g., helicopter, squad vehicle, advanced life support (ALS), bariatric life support (BLS), etc.) or other suitable criteria.

There are no limitations on the size and shape of the area (e.g., polygon) corresponding to a custom layer. For example, FIG. 14B shows shaded area 1450 having an arbitrary shape selected by the personnel of a first responder agency. All resources located within shaded area 1450 are subjected to a 10-minute delay in response time between 00:00 hours and 23:59 hours. In some embodiments, a custom delay can be conditionally proposed for an emergency unit to account for realistic considerations. For example, if one emergency units has undergone several back-to-back shifts with zero or hardly any breaks in between successive deployments, adding the custom delay ensures that the unit does not need to be pulled in to respond to another emergency situation. Thus, one advantage of adding a custom delay is a form of "weighting" the individual emergency units for purposes of load balancing to ensure that the load of responding to emergency situations is balanced with some degree of fairness and factoring realistic considerations in deciding which units to select for responding to a given emergency situation.

In some embodiments, a first responder may desire to assess the utilization of a given emergency unit. Utilization of the unit can be measured on the basis of several metrics. Examples of the metrics include number of assignments for current shift, number of assignments over a certain time, number of emergency situation assignments occurred outside the emergency unit's 'home' area over a certain time, number of emergency response assignments occurred inside the emergency unit's 'home' area over a certain time, number of miles driven by the emergency unit inside and/or outside the home area, number of emergency situation assignments from primary first responder, number of emergency situation assignments from partnering first responders, total amount of downtime at station, total amount of downtime outside of station, and other suitable metrics. Because the emergency unit personnel can be overloaded with repeated (e.g., back-to-back assignments), to ensure fairness and work balance, the report can help prevent crew (personnel) fatigue and potentially tragic consequences of crew members(s) falling asleep during their assignment(s) to emergency situations. In some embodiments, this feature can be included as part of a live tracking module that can recommend or highlight to dispatchers or operations staff when a crew reaches a certain threshold so that downtime can be considered. Some crews work back-to-back 24-hour shifts so one or more crew members could reach fatigue thresholds much faster than a fresh crew on another unit. Maybe crew members have had a certain number of back-to-back assignments and have had only minutes in between calls for the previous 5 hours. The thresholds for determine balancing of workloads in responding to emergency situations can be adjusted by managers of a first responder. For example, thresholds can be based on the time of day such that thresholds for business during normal daytime hours can be less strict than those for crews working overnight.

FIG. 15 illustrates example details of utilization of resources as part of a report depicted on an interface of the disclosed emergency response system. The report shows metrics (e.g., percentages of times with respect to an overall time period) of utilization (in area 1502 of the report) of EMS units inside a polygon termed Smith County during Nov. 9-11, 2018 (e.g., the overall time period). For example, the report indicates that an available EMS unit was inside the polygon 35% of the time, any available EMS unit was inside the polygon 20% of the time, and no EMS units were inside the polygon 7% of the time. Column 1504 specifies the actual times, percentages, total miles driven, miles driven number on assignment, and number of assigned calls/emergency situations for several emergency units located inside the polygon/custom layer termed Smith County. Column 1506 specifies the above-mentioned data and analytics for the emergency units located outside the polygon/custom layer termed Smith County. Although the percentage utilization in the report is shown with respect to EMS units, in alternate embodiments, the percentage utilization can be calculated for different types of emergency units. Also, the report in FIG. 15 is for illustrative purposes only. In alternate embodiments, other suitable analytics and/or metrics can be indicated in the report. In some embodiments, the utilization metrics are factored in calculation of candidate rankings of first responders (resources) eligible for assignment in responding to an emergency situation. In some embodiments, the utilization metrics are stand alone and not used in the calculation of candidate rankings.

Figure 16:
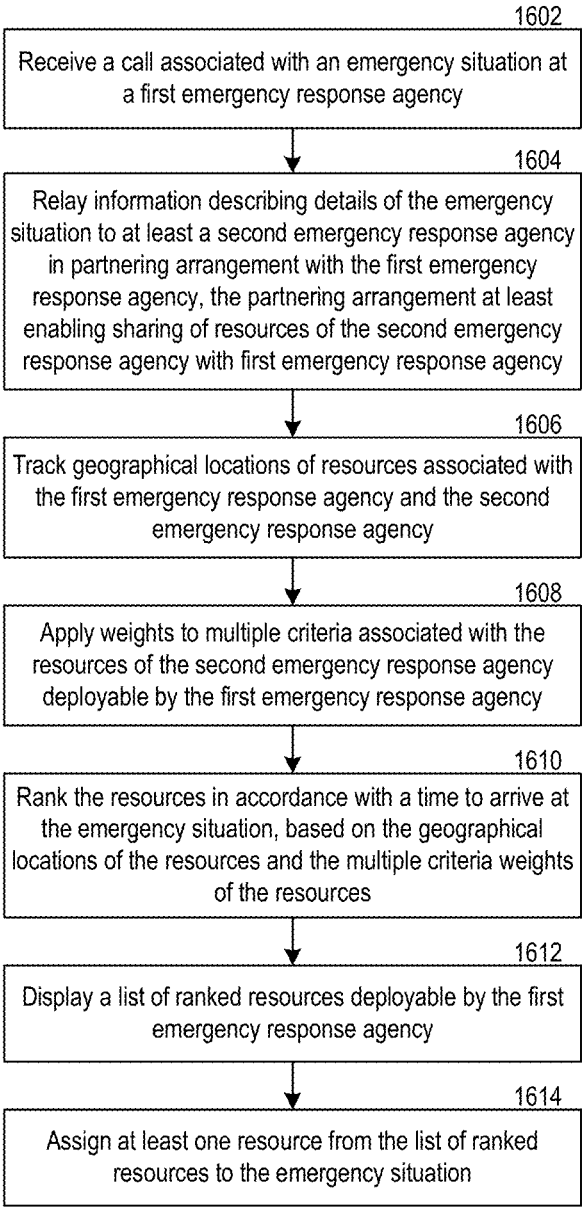
FIG. 16 is an example flowchart of a process for generating a ranked list of candidate first responders eligible for assignment in responding to an emergency situation.

FIG. 16 is an example flowchart of a process for generating a ranked list of candidate first responders eligible for assignment in responding to an emergency situation. The steps of this process can be implemented at a computer aided dispatch (CAD) computer server associated with a first responder (emergency response agency). Generally, the computer aided dispatch (CAD) computer server can be a physical or cloud computer server, located on-premise or off-premise with respect to the dispatch center location. At step 1602, the computer aided dispatch (CAD) computer server at a first emergency response agency receives a call (via a Public Switched Telephone Network (PSTN) or an Internet Protocol (IP) network) relating to an emergency situation. Information relating to the call is entered into a database coupled to the server. The information relating to the call can include details of the type of the incident, a time of receiving the call, a location of the incident and other suitable details/aspects. At step 1604, the process relays information relating to the emergency situation to at least a second emergency response agency in partnering agreement with the first responder agency. The partnering agreement enables sharing of the resources of the second emergency response agency with the first emergency response agency, and vice versa. At step 1606, the process tracks (e.g., using GPS, Wi-Fi, Bluetooth or other suitable location-based technologies) the geographical locations of resources associated with the first emergency response agency or the second emergency response agency. For example, a GPS transceiver coupled to the resource can provide location information of the resource to the process in real time or near real time. At step 1608, the process applies weights to criteria associated with the resources of the second emergency response agency, the resources being deployable by the first emergency response agency. The criteria can be pre-programmed into the system (or, entered on-the-fly) by personnel of the first emergency response agency or the second emergency response agency. The weights applied by the process correspond to the values of the criteria. In some embodiments, the weights are universal—one set of weights for everything. In some embodiments, the weights can be custom. For example, the weights can be dependent on a status of a resource, a type of an emergency situation, or a type of a resource. At step 1610, the process ranks the resources (belonging to the first emergency response agency or the second emergency response agency) based on the individual locations of the resources (with respect to the location of the emergency situation) and the weights for the criteria of the resources. In some embodiments, the ranking is in accordance with an estimated time for an individual resource to arrive at the emergency situation. In addition to the criteria associated with a given resource, the ranking can also factor real-time situations such as weather, live traffic, road closures, crash notifications, etc. At step 1612, the process displays a list of the ranked resources optionally along with an accompanying estimated time for an individual resource in the list to arrive at the emergency situation. In some embodiments, the ranks of the resources calculated by the process can include public or private information retrieved from remote servers. Finally, at step 1614, the process assigns at least one resource (e.g., the resource with rank #1) in the list to the emergency situation. In some embodiments, the ranks factor in utilizations of individual resources. Non-limiting examples of utilization metrics include a percentage of time the resource is available inside the geographical boundary, a percentage of time a resource of a same type is inside the geographical boundary, or a percentage of time no resource of a same type stays is inside the geographical boundary.

Some of the embodiments described herein are described in the general context of methods or processes, which may be implemented in one embodiment by a computer program product, embodied in a computer-readable medium, including computer-executable instructions, such as program code, executed by computers in networked environments. A computer-readable medium may include removable and non-removable storage devices including, but not limited to, Read Only Memory (ROM), Random Access Memory (RAM), compact discs (CDs), digital versatile discs (DVD), etc. Therefore, the computer-readable media can include a non-transitory storage media. Generally, program modules may include routines, programs, objects, components, data structures, etc. that perform particular tasks or implement particular abstract data types. Computer- or processor-executable instructions, associated data structures, and program modules represent examples of program code for executing steps of the methods disclosed herein. The particular sequence of such executable instructions or associated data structures represents examples of corresponding acts for implementing the functions described in such steps or processes.

Some of the disclosed embodiments can be implemented as devices or modules using hardware circuits, software, or combinations thereof. For example, a hardware circuit implementation can include discrete analog and/or digital components that are, for example, integrated as part of a printed circuit board. Alternatively, or additionally, the disclosed components or modules can be implemented as an Application Specific Integrated Circuit (ASIC) and/or as a Field Programmable Gate Array (FPGA) device. Some implementations may additionally or alternatively include a digital signal processor (DSP) that is a specialized microprocessor with an architecture optimized for the operational needs of digital signal processing associated with the disclosed functionalities of this application. Similarly, the various components or sub-components within each module may be implemented in software, hardware or firmware. Also, many of the software modules can be provided as widgets to end users. For example, the candidate rankings tool and the system-wide summary of response to several emergency situations by different mobile emergency units in real-time or near real-time can be provided as widgets. The connectivity between the modules and/or components within the modules may be provided using any one of the connectivity methods and media that is known in the art, including, but not limited to, communications over the Internet, wired, or wireless networks using the appropriate protocols.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and its practical application to enable one skilled in the art to utilize the present invention in various embodiments and with various modifications as are suited to the particular use contemplated. The features of the embodiments described herein may be combined in all possible combinations of methods, apparatus, modules, systems, and computer program products.

We claim:

1. A system for assigning resources to an incident based on partnerships between at least two emergency response agencies, the system comprising:

at least one processor having executable instructions configured for:

receiving a call associated with an incident at a first emergency response agency;

relaying information describing aspects of the incident to at least a second emergency response agency in partnership with the first emergency response agency, the partnership at least enabling sharing of resources of the second emergency response agency with the first emergency response agency;

tracking geographical locations of resources associated with the first emergency response agency and the second emergency response agency;

applying weights to criteria associated with the resources of the second emergency response agency that are deployable by the first emergency response agency, wherein the criteria at least include the geographical locations of resources associated with the first emergency response agency and the second emergency response agency;

ranking the resources in accordance with a time to arrive at the incident, based on the weights of the criteria associated with the resources;

displaying, on a user interface, a list of ranked resources deployable by the first emergency response agency; and assigning at least one resource from the list of ranked resources to the incident.

2. The system of claim 1, wherein the resources include one or more vehicles, one or more robots, or one or more personnel that are located on the ground, air borne, or under water.

3. The system of claim 1, wherein the criteria associated with resources include any of: a proposed delay in responding to the incident, a status of a resource, a type of the incident, one or more utilization metrics of a resource, or a type of a resource.

4. The system of claim 3, wherein the status of an emergency unit includes enroute, at scene, and at destination.

5. The system of claim 3, wherein the proposed delay in responding to the incident includes a value of the proposed delay and an associated date, time of the proposed delay.

6. The system of claim 3, wherein the proposed delay in responding to the incident is applicable when the resource is located within a geographical boundary specified by the second emergency response agency.

7. The system of claim 6, wherein the one or more utilization metrics of the resource include a percentage of time the resource is available inside the geographical boundary, a percentage of time a resource of a same type is inside the geographical boundary, or a percentage of time no resource of a same type stays is inside the geographical boundary.

8. The system of claim 1, wherein the ranking is further based on weather, live traffic, road closures, or crash notifications.

9. The system of claim 1, wherein the ranking is based on public or private information retrieved from one or more servers remotely located from the processor.

10. The system of claim 1, wherein the list of ranked resources includes an estimated time of a resource in the list to arrive at the incident.

11. The system of claim 1, wherein the instructions are further configured for:

receiving, from the second emergency response agency, a selection of an option for complete viewing, partial viewing, or no viewing of the resources by the first emergency response agency.

12. The system of claim 1, wherein the instructions are further configured for:

displaying, via a mapping application on the user interface, a perceptible representation of a maximum allowable time to respond to the incident based on an average speed of travel of the at least one resource to the incident.

13. The system of claim 12, wherein the perceptible representation corresponds to a circle drawn around the incident with the radius of the circle corresponding to the maximum allowable time, and wherein the displaying includes:

determining that the maximum allowable response time has not elapsed; and upon determining that the maximum allowable response time has not elapsed, causing successive constrictions in size of the circle on the user interface, until the at least one resource arrives at the location.

14. A method for assigning resources to an incident based on partnerships between at least two emergency response agencies comprising:

receiving a call associated with an incident at a first emergency response agency;

relaying information describing aspects of the incident to at least a second emergency response agency in partnership with the first emergency response agency, the partnership at least enabling sharing of resources of the second emergency response agency with the first emergency response agency;

tracking geographical locations of resources associated with the first emergency response agency and the second emergency response agency;

applying weights to criteria associated with the resources of the second emergency response agency that are deployable by the first emergency response agency, wherein the criteria at least include the geographical locations of resources associated with the first emergency response agency and the second emergency response agency;

ranking the resources in accordance with a time to arrive at the incident, based on the weights of the criteria associated with the resources;

displaying, on a user interface, a list of ranked resources deployable by the first emergency response agency; and assigning at least one resource from the list of ranked resources to the incident.

15. The method of claim 14, wherein the criteria associated with resources include any of: a proposed delay in responding to the incident, a status of a resource, a type of the incident, one or more utilization metrics of a resource, or a type of a resource.

16. The method of claim 15, wherein the status of an emergency unit includes enroute, at scene, and at destination.

17. The method of claim 15, wherein the proposed delay in responding to the incident includes a value of the proposed delay and an associated date, time of the proposed delay.

18. The method of claim 15, wherein the proposed delay in responding to the incident is applicable when the resource is located within a geographical boundary specified by the second emergency response agency.

19. A non-transitory computer-readable medium comprising instructions configured to cause at least one computer processor to perform a method comprising:

receiving a call associated with an incident at a first emergency response agency;

relaying information describing aspects of the incident to at least a second emergency response agency in partnership with the first emergency response agency, the partnership at least enabling sharing of resources of the second emergency response agency with the first emergency response agency;

tracking geographical locations of resources associated with the first emergency response agency and the second emergency response agency;

applying weights to criteria associated with the resources of the second emergency response agency that are deployable by the first emergency response agency, wherein the criteria at least include the geographical locations of resources associated with the first emergency response agency and the second emergency response agency;

ranking the resources in accordance with a time to arrive at the incident, based on the weights of the criteria associated with the resources;

assigning at least one resource from the resources ranked in accordance with a time to arrive at the incident; and causing display of a perceptible representation of a maximum allowable time to respond to the incident based on an average speed of travel of the at least one resource to the incident.

20. The non-transitory computer-readable medium of claim 19, wherein the resources include one or more vehicles, one or more robots, or one or more personnel that are located on the ground, air borne, or under water.

* * * * *